United States Patent [19]

Kupperman et al.

[11] 4,134,227

[45] Jan. 16, 1979

[54] PARACHUTE KIT

[75] Inventors: Sam Kupperman, Chicago; Dennis Kupperman, Glenview, both of Ill.

[73] Assignee: RB Toy Development, Skokie, Ill.

[21] Appl. No.: 772,303

[22] Filed: Feb. 25, 1977

[51] Int. Cl.[2] ..... A63H 33/20

[52] U.S. Cl. ..... 46/86 R

[58] Field of Search ..... 46/86 R, 86 A, 86 B, 46/86 C

[56] References Cited

U.S. PATENT DOCUMENTS

| | | | |
|---|---|---|---|
| 1,492,709 | 5/1924 | Hall | 46/86 A |
| 1,618,613 | 2/1927 | Turner | 46/86 R |

FOREIGN PATENT DOCUMENTS

| | | | |
|---|---|---|---|
| 1016667 | 11/1952 | France | 46/86 A |
| 1161204 | 4/1958 | France | 46/86 R |

*Primary Examiner*—Russell R. Kinsey
*Assistant Examiner*—Mickey Yu
*Attorney, Agent, or Firm*—Vogel, Dithmar, Stotland, Stratman & Levy

[57] ABSTRACT

A toy parachute kit having a toy parachute comprising a frame member which includes a central base and a plurality of spaced, radially extending flexible arms with the arms having canopy attaching means at their outer ends. The entire frame member is integrally formed as a single unit of plastic material in an injection molding machine. A canopy is attachable to said canopy attaching means so that the frame and the canopy form a toy parachute. The parachute is collapsed by bending the arms towards each other and folding the canopy. The parachute in this collapsed position is inserted in a tubular member from which it is manually blown outwardly. The diameter of the central member or base is greater than the diameter of the tubular member so that the parachute cannot accidentally or otherwise be sucked into the mouth of the user. The collapsed frame and folded canopy, while in the tubular member serves as a gasket to block the passage of air so that air blown therethrough ejects the parachute from the tubular member. Upon ejection the collapsed and inwardly bent arms spread outwardly to their normal position so as to open the canopy and to right the parachute and permitting it to descend normally.

9 Claims, 10 Drawing Figures

PARACHUTE KIT

SUMMARY OF THE INVENTION

One of the objects of this invention is to provide a toy parachute kit which may be economically produced so as to be used as a give-away premium item packaged with cereal or other food product and which will meet the safety requirements of the U.S. Government Consumer Products Safety Commission as to safety regulations.

Another object of the present invention is to provide a toy parachute kit comprising an integrally formed frame having a central base and a plurality of radially extending resilient arms, canopy attaching means secured to said arms, a canopy attachable to said canopy attaching means, and a tubular member, said frame insertable into said tubular member with said arms bent toward each other and said canopy collapsed to block the passage of air blown into said tube, said tubular member when engaged by a person's mouth and with the person's air blown therein causing said frame with the canopy attached thereto to be ejected from said tubular member and into the air so that said resilient arms spring into the extended position thereof stretching said canopy attached thereto to retard the descent of said frame and canopy.

Another object of this invention is to provide a parachute which, when inserted into the tubular member from which it is blown, is so constructed that it cannot be injested by the user, but can only be ejected outwardly of the tube into the air so that no injury can befall the user, nor can it cause injury when ejected into the air.

These and other objects of the present invention may more readily be understood by reference to the following specification taken in conjunction with the drawings, in which:

DESCRIPTION OF THE PREFERRED EMBODIMENT

Figure 1:
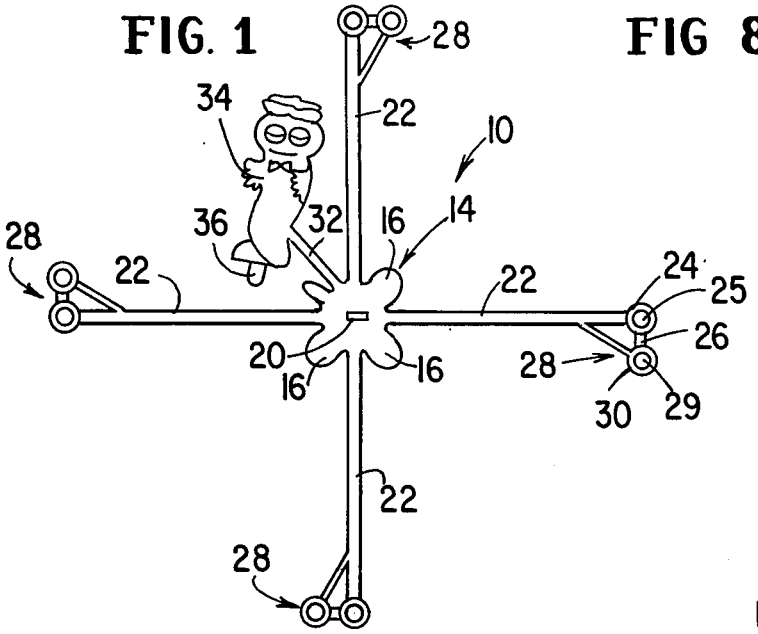
FIG. 1 is a plan view of the parachute frame and figure which is integrally molded of plastic material as a single unit in an injection molding machine.

The parachute is formed of a frame generally indicated at 10 and a canopy generally indicated at 12. The frame is integrally molded of semirigid, but flexible plastic material, such as low density polyethylene and said frame includes a central base 14, preferably circular in plan view which includes a plurality of spaced arcuate-shaped segments 16 and a spaced segment 18. The three spaced segments 16 are of equal dimension, but the spaced segment 18 is of a reduced dimension to accommodate an attaching strip 32 to support a simulated toy figure 34 to be described. The central base 14 has a central rectangular shaped opening or slot 20. Extending from the central base 14 and between the spaced segments 16 and 18, are four equally spaced, radially extending flexible arms 22, which are part of the frame 10 and which form the lines to which the canopy 12 is connected. The outer end of each of the arms 22 has a circular enlargement 24 provided with an annular opening 25. Hingedly connected to the enlargement 24 by a short connector strip 26 and a strut 27, is a knob-like member or button generally indicated at 28 which has a circular body 29 and a head 30. The strut 27 plays an important part in the packaging of the present invention, as will be described.

Figure 5:
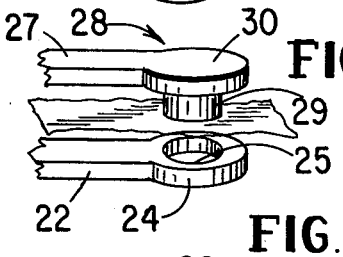
FIG. 5 is an enlarged view showing the canopy being attached to the arm of the parachute frame.
Figure 3:
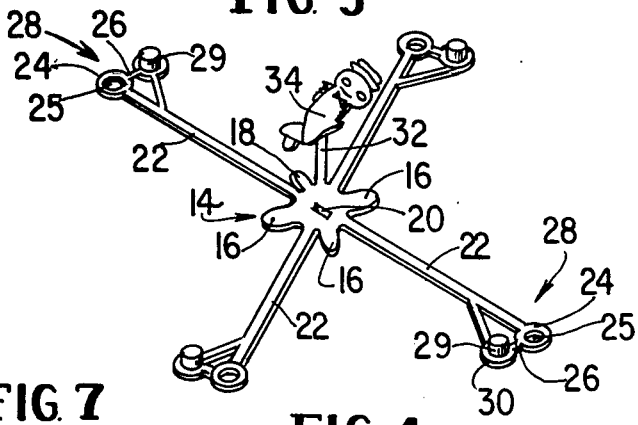
FIG. 3 is a perspective view of FIG. 1.
Figure 6:
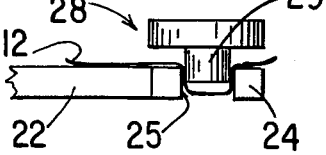
FIG. 6 is a view showing the canopy attached to the arm.
Figure 7:
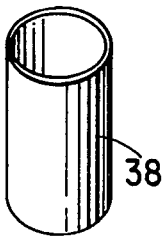
FIG. 7 is a view of the tubular member forming the blower.

The edge of the canopy 12 to be more fully described, is secured to each of the arms 22 of the frame 10 as best shown in FIGS. 5 and 6, by positioning the edge of the canopy 12 over the opening 25 and hinging the button 28 over the opening 25 and then inserting the body 29 of the button into the opening 25 to hold the canopy edge wedged between said opening 25 and button 28 and secured to the arm 22.

Extending radially from the central base 14, is the short hinge connector 32 to which is integrally connected the toy character or simulated toy figure 34 of any desired configuration. The figure 34 has a rectangular shaped projection 36 at the bottom thereof, which, when the toy figure is positioned upright with respect to the base, is inserted in the rectangular base opening or slot 20 to hold the figure upright and substantially perpendicular relative to the plane of the base 14 of the frame 10. The entire frame 10 just described, is integrally molded as a single unit of plastic material and is molded in an injection molding machine in the form shown in FIG. 1. The arms 22 are sufficiently flexible to permit the arms to be bent or hinged towards each other to the collapsed position shown in FIG. 8, and to permit the folding of the canopy 12 so that the parachute can be inverted and then inserted into a tubular member 38 up to the base or central member 14. The short connectors 26 and 27 and connector 32 are likewise flexible to permit the positioning of the button 28 over the opening 25 and the securement of the canopy 12 thereto. The flexible connector 32 permits positioning of the figure 34 relative to the base 14 so that the projection 36 can be inserted into the slot 20 to hold the figure 34 upright relative to the base. For packaging this toy in cereal boxes, the frame 10 is dimensioned to measure 4" by 4" and the tube 38 is at least 2 inches long to meet Federal standards, although it will be understood that when made into a larger toy, the dimensions will be increased.

Figure 4:
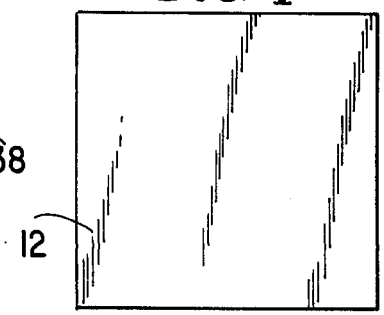
FIG. 4 is a plan view of the canopy before attachment to the frame.
Figure 10:
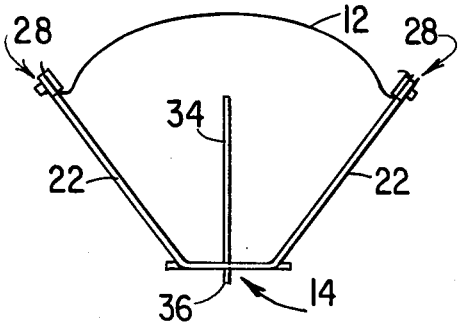
FIG. 10 is an elevational view of the parachute as it would descend after being blown from the tubular member.

The canopy 12 is a flexible and foldable film or sheet formed from polyethylene, and since the frame member 12 just described and the tubular blower 38, hereinafter more fully described, is packaged in an envelope, package or wrapping to be placed in the cereal or food product box to meet the Government safety regulations, the package or envelope or wrapping can be made of this film or sheet and one of the sides thereof is marked off, so that the child can cut away the marked off portion and use the cut out portion as the chute or canopy, thus further reducing the cost of the toy. The cut out portion forming the canopy is shown in FIG. 4, is preferably a square or approximately 3" × 3" for the size of the frame herein described. With the canopy 12 secured to the arms 22 of the frame 10 as described and with the figurine 34 supported in upright position on the base 14 within and between the arms 22, the toy is ready to be used and positioned in the tubular member generally indicated at 38. The tubular member 38 is preferably extruded of soft or semirigid plastic and for the hereindescribed dimensioned frame is approximately 2 inches in length and has a diameter of ⅝" internal diameter. The tubular member 38 is sufficiently long to pass Consumers' Products Safety Commission's safety regulations. It should be understood that this invention is not restricted to the dimensions herein set forth, but that a toy so constructed may be made of any desired size. The dimensions herein are principally to indicate the size for a toy which can be packaged, contained in a cereal box preferably as a premium item.

Figure 8:
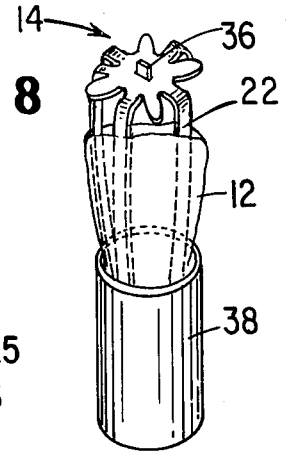
FIG. 8 is a view showing the parachute collapsed and being inserted into the tubular member.
Figure 2:
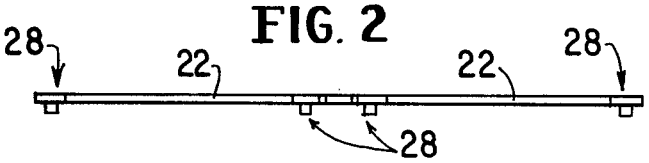
FIG. 2 is a side elevational view taken on lines 2—2 of FIG. 1.
Figure 9:
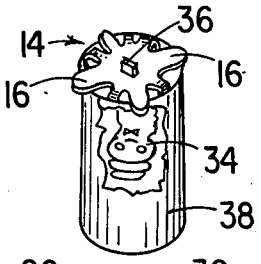
FIG. 9 is a view showing the position of the parachute inserted in the tubular member and in the position it would be just prior to being blown out of the tubular member.

To operate the toy parachute, the arms 22 of the frame member 10 are bent towards each other and the canopy 12 is folded. The collapsed parachute is inverted and inserted into the tubular member as shown in FIG. 8. When the frame is collapsed by bending the arms 22 upwardly towards each other, the figure 34 will be positioned in the center and between the arms 22. The canopy 12 is then folded over the arms 22 and the unit is then inserted into the tubular member 38 in the manner shown in FIG. 8, so that the folded canopy enters the tubular member first. The diameter of the base 14, which includes the segments thereof, is slightly greater than the diameter of the tube 38 so that with the arms bent upwardly toward each other, the base 14, will as shown in FIG. 9, limit the insertion of the parachute so that the base 14 extends over the edge of the tube 38. This will prevent the child from inhaling the parachute into its mouth, should the child accidentally suck inwardly.

When in the fully loaded position as in FIG. 9, the arms 22, the figure 34 and the collapsed canopy 12, are positioned within the tubular member 38. This blocks the interior of the tubular member 38 and serves as a gasket and allows the parachute to be blown from the tube. When the child puts the opposite end of the tube 38 into its mouth and blows into the tube, the air will cause the parachute to be ejected upwardly into the air and due to the fact that the arms 22 have been bent inwardly towards each other, the arms of the parachute, when ejected, will immediately spread and assume their normal spread-out position, so that the canopy 12 is opened promptly. As the canopy 12 opens, the weight of the base 14 and the figure 34 is greater than that of the weight of the arms 22, the parachute will be righted so that the base is below the canopy and the parachute will descend in the conventional manner. The flexible arms 22 and the manner in which they tend to restore to their normal position cause the canopy 12 to open automatically and promptly instead of relying only on the air.

As stated, the parachute material or canopy 12 forms a gasket and allows the parachute to be blown from the tube 38. This eliminates the possibility of a child blowing or shooting it at another child as to cause injury. With the canopy 12 attached, the missile velocity is reduced sufficiently so as not to cause injury if it strikes another child.

To package the frame 10 into the canopy 12, many frames are stored in a single container. Removal of one frame 10 resulted in dragging out many tangled frames until the angular strut 27 was added. The strut 27 forming an angle of about 45° with the arms 22 almost entirely eliminates the problems and results in a commercially possible product.

The structure consists of essentially an integrally formed frame 10 as a single unit and a separate tubular member 38 as the blower, with the canopy 12 formed from the package for both. The forming of the frame 10 in a single operation in an injection molding machine reduces the cost of manufacture and eliminates assembly of the parts; thus the product can be economically and inexpensively mass produced and is sufficiently low in price so that it can be used as a premium item. Also, by virtue of its construction and the integral formation of the frame, it meets the Government Consumer Products Safety Commission's standards as to safety and thus may be packaged in a cereal or food product package.

While there has been described what at present is considered to be the preferred embodiment of the present invention, it will be understood that various alterations and modifications may be made therein without departing from the true spirit and scope of the present invention, which alterations and modifications are intended to be covered in the appended claims.

What is claimed is:

1. A toy parachute kit comprising an integrally formed frame having a central base, a plurality of radially extending resilient arms normally substantially coplanar with said base, canopy attaching means secured to said arms, and a canopy attachable to said canopy attaching means, said canopy and said arms being attached so that movement of said arms toward the normal position thereof automatically stretches said canopy open, and a tubular member, said frame insertable into said tubular member with said arms bent toward each other and said canopy collapsed to block the passage of air blown into said tube, said tubular member when engaged by a person's mouth and with the person's air blown therein causing said frame with the canopy attached thereto to be ejected from said tubular member and into the air so that said resilient arms spring toward the normal radially extended position thereof automatically stretching said canopy attached thereto to the open position thereof to retard the descent of said frame and canopy.

2. A toy parachute kit comprising an integrally formed frame having a central base, a plurality of radially extending resilient arms normally substantially coplanar with said base, canopy attaching means secured to said arms, a canopy attachable to said canopy attaching means, and a tubular member, said base having an effective diameter exceeding that of said tube to prevent said base from passing through said tube, said frame insertable into said tubular member with said arms bent toward each other and said canopy collapsed to block the passage of air blowing into said tube, said tubular member when engaged by a person's mouth and with the person's air blown therein causing said frame with the canopy attached thereto to be ejected from said tubular member and into the air so that said resilient arms spring toward the normal radially extended position thereof stretching said canopy attached thereto to retard the descent of said frame and canopy.

3. A toy parachute kit as set forth in claim 2, in which a simulated toy figure is formed integrally with said central base and is connected thereto by flexible means, said central member having means for detachably receiving said figure to hold same in an upright position centrally of said arms.

4. A toy parachute kit as set forth in claim 2, in which the canopy attaching means is an integral part of the arm and in which the entire frame including the canopy attaching means is integrally formed of resilient plastic material.

5. A toy parachute kit as set forth in claim 4, in which the canopy attaching means comprises an opening in the associated resilient arm and a button member insertable in said opening to hold a portion of the canopy therebetween.

6. A toy parachute kit as set forth in claim 5, in which a strut interconnects said button with the associated resilient arm and forms an angle of about 45° therewith.

7. A toy parachute kit as set forth in claim 2, in which the canopy attaching means is an integral part of each arm and comprises an enlargement at the end of said arm having an opening therein, and a button hingedly secured to said enlargement, whereby a portion of the canopy adjacent the outer edge inserted between said opening and button is secured by positioning said button into said opening.

8. A toy parachute kit as set forth in claim 2, wherein a thin plastic film package contains said toy figure said base, said arms and said tube, which plastic film package is said canopy.

9. A structure for use as a toy parachute, comprising a central base having a slot therein, a figure connected to said base having a tab extending therefrom sized to fit securely within said slot and retain said figure substantially perpendicular to said base, a plurality of flexible and resilient arms extending radially outwardly of said base, and canopy attachment means on each of said arms at the distal end thereof, said canopy attachment means each comprising a button and a complimentary shaped collar frictionally receiving said button therein, said button being connected to said arm by a flexible strut forming an angle of about 45° with said arm.

* * * * *